US007210616B1

(12) United States Patent
Van Watermulen

(10) Patent No.: US 7,210,616 B1
(45) Date of Patent: May 1, 2007

(54) EXTENDABLE CURBSIDE MAILBOX

(76) Inventor: Dan Van Watermulen, 8567 Happy Camp Rd., Moorpark, CA (US) 93021-9726

( * ) Notice: Subject to any disclaimer, the term of this patent is extended or adjusted under 35 U.S.C. 154(b) by 0 days.

(21) Appl. No.: 11/507,983

(22) Filed: Aug. 23, 2006

(51) Int. Cl.
*A47G 29/12* (2006.01)

(52) U.S. Cl. ..... 232/29; 232/17

(58) Field of Classification Search ..... 232/29, 232/33, 17; D99/29–32
See application file for complete search history.

(56) References Cited

U.S. PATENT DOCUMENTS

| | | | | | |
|---|---|---|---|---|---|
| 838,194 | A | * | 12/1906 | Larsh | 232/17 |
| 1,021,792 | A | * | 4/1912 | Overmyer et al. | 232/33 |
| 2,723,098 | A | | 11/1955 | Moore | |
| 3,497,078 | A | | 2/1970 | Nash | |
| 3,870,262 | A | | 3/1975 | Manning, Jr. | |
| 4,821,952 | A | | 4/1989 | Deciutiis | |
| 4,896,827 | A | * | 1/1990 | Economou | 232/17 |
| 5,271,555 | A | * | 12/1993 | Mayer | 232/17 |
| 5,425,501 | A | * | 6/1995 | Wesorick | 232/17 |
| D376,464 | S | | 12/1996 | Cunningham et al. | |
| D376,891 | S | * | 12/1996 | Wooten et al. | D99/31 |
| 5,775,578 | A | * | 7/1998 | Baxi et al. | 232/17 |
| 6,655,577 | B2 | * | 12/2003 | Mihaylov et al. | 232/45 |
| 6,698,651 | B1 | * | 3/2004 | Green | 232/29 |
| 6,997,373 | B2 | * | 2/2006 | Flores | 232/29 |

OTHER PUBLICATIONS

Mailbox Extender Tray web page http://www.awesometools.com/mailboxes.asp.

* cited by examiner

*Primary Examiner*—William L. Miller
(74) *Attorney, Agent, or Firm*—Vincent Tassinari

(57) ABSTRACT

This patent discloses a curbside mailbox assembly having a mailbox adapted to be attached to a post. The mailbox may include a base and a cover attached to the base to form a compartment. The mailbox additionally may include a platform attached to the mailbox base, a door attached to the platform, and a basket assembly. The basket assembly may include a basket, a first slide rail assembly, and a second slide rail assembly. The basket may be an openwork container having tabs.

11 Claims, 9 Drawing Sheets

EXTENDABLE CURBSIDE MAILBOX

BACKGROUND

1. Field of Endeavor

The information disclosed in this patent relates to a mailbox having movement that may aid in mail collection by both the user and postal carrier and aid in delivery by the postal carrier.

2. Background Information

In just about every country, postal mail is delivered to one type of receptacle or another. In the United States, mail receptacles may be broken down into (i) multiple compartment troughs such as those used with apartment houses, (ii) door slots for city delivery, (iii) wall-mounted centralized mailboxes for city delivery, and (iv) curbside mailboxes for rural, highway contract, and city delivery.

The United States Postal Services (USPS) maintains particular regulations regarding curbside mailbox sizes and installation. For example, "customer mail receptacles" (as they are antiseptically known by the USPS) must be placed so they can be safely and conveniently served by postal carriers without leaving their right-hand-side driven vehicles. Curbside mailbox should be installed with the bottom of the box at a vertical height of between 3½ to 4 feet from the road surface and with the mailbox door at a distance of six to eight inches from the front face of the curb.

While these regulations may meet the needs of the United States Postal Services, they do not address the needs of the rural and highway contract customer who desires to retrieve all the mail from a roadside mailbox while in a vehicle or while the mailbox is enclosed by a bank of snow. The elderly and people with physical disabilities particularly have such needs. Moreover, a mail carrier also may need additional assistance in delivering mail while the mailbox is enclosed by a bank of snow.

While inventors have proposed some solutions to these needs, each one fall short in one or more areas. Some are difficult to install and others are complicated or difficult to use. Many are inconvenient and unaffordable. What is needed is an apparatus and method to overcome these and other problems.

SUMMARY

This patent discloses a curbside mailbox assembly having a mailbox adapted to be attached to a post. The mailbox may include a base and a cover attached to the base to form a compartment. The mailbox additionally may include a platform attached to the mailbox base, a door attached to the platform, and a basket assembly. The basket assembly may include a basket, a first slide rail assembly, and a second slide rail assembly. The basket may be an openwork container having tabs.

DETAILED DESCRIPTION

Figure 1:
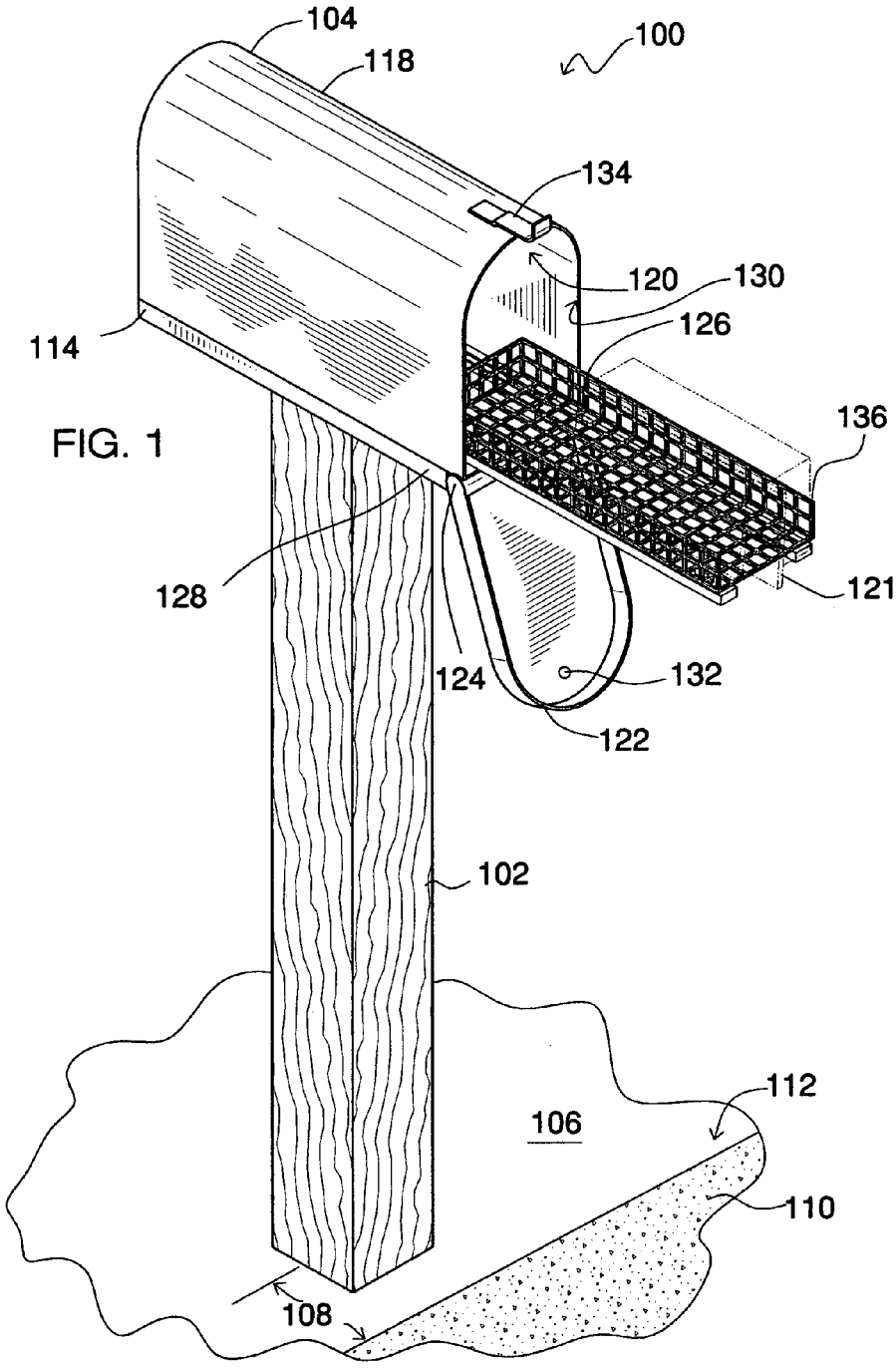
FIG. 1 is an isometric view of a mailbox assembly 100.

FIG. 1 is an isometric view of a mailbox assembly 100. Mailbox assembly 100 may receive and hold postal material that has been delivered by a postal carrier for collection by a user or is awaiting collection by that postal carrier. In either situation, movement provided by mailbox assembly 100 may aid in mail collection by both the user and postal carrier and aid in delivery by the postal carrier.

Mailbox assembly 100 may include a post 102 and a mailbox 104. Post 102 may be any material, including wood or metal, set upright into a ground 106 to serve as a support for mailbox 104. Post 102 may be secured in ground 106 at a distance 108 from a road 110 (including a roadway, a pavement, or a street). Mailbox assembly 100 may be located on a side 112 of road 110 that may be bordered by a curb or not bordered by a curb such that mailbox 102 interchangeably may be thought of as a curbside mailbox and a roadside mailbox.

Mailbox 104 may include a platform 114, a base 116 (FIG. 2), and a cover 118. Platform 114 may be any object that may provide a raised horizontal surface, including a plank of wood. Platform 114 may include platform holes 115 (see FIG. 2) that may be utilized to secure platform 114 to base 116. Platform 114 additionally may include countersunk post holes 117 (see FIG. 2) that may be utilized to secure platform 114 to post 102.

Base 116 may be a flat continuous surface or a flat surface composed of two or more pieces. Cover 118 may provide a shield and be of any shape, including U-shaped or ornamental figurine shape. An arrangement of base 116 and cover 118 may form a compartment 120. Compartment 120 may be adapted to receive delivery and permit collection of materials 121, including but not limited to letters and packages handled in a postal system. Base 116 may receive horizontal, stable support from platform 114, irrespective of an angle at which post 102 may support platform 114. Shims (not shown) may be placed between platform 114 and post 102 to provide a horizontal, stable support for base 116. Base 116 may include base holes 123 (see FIG. 2) that may be utilized to secure base 116 to platform 114. Thus, mailbox 104 may be thought of as a single compartment mailbox mounted on a secure pedestal for outdoor curbside use, such as in rural area.

Mailbox 104 additionally may include a door 122. Door 122 may be any movable structure adapted to be used to close compartment 120 partially or completely. Door 122 may be a panel that may swing on a first hinge 124 and a second hinge 126. Door 112 may be connected to platform 114 at a platform end 128 by first hinge 124 and second hinge 126. This may permit door 112 to move complete away from compartment opening 130 as shown in FIG. 1. Alternatively, door 112 may be connected to cover 118. Door 112 may include a door handle 132 on an exterior portion of door 112 and be secured to close compartment opening 130 by a door latch 134.

Figures 2, 3:
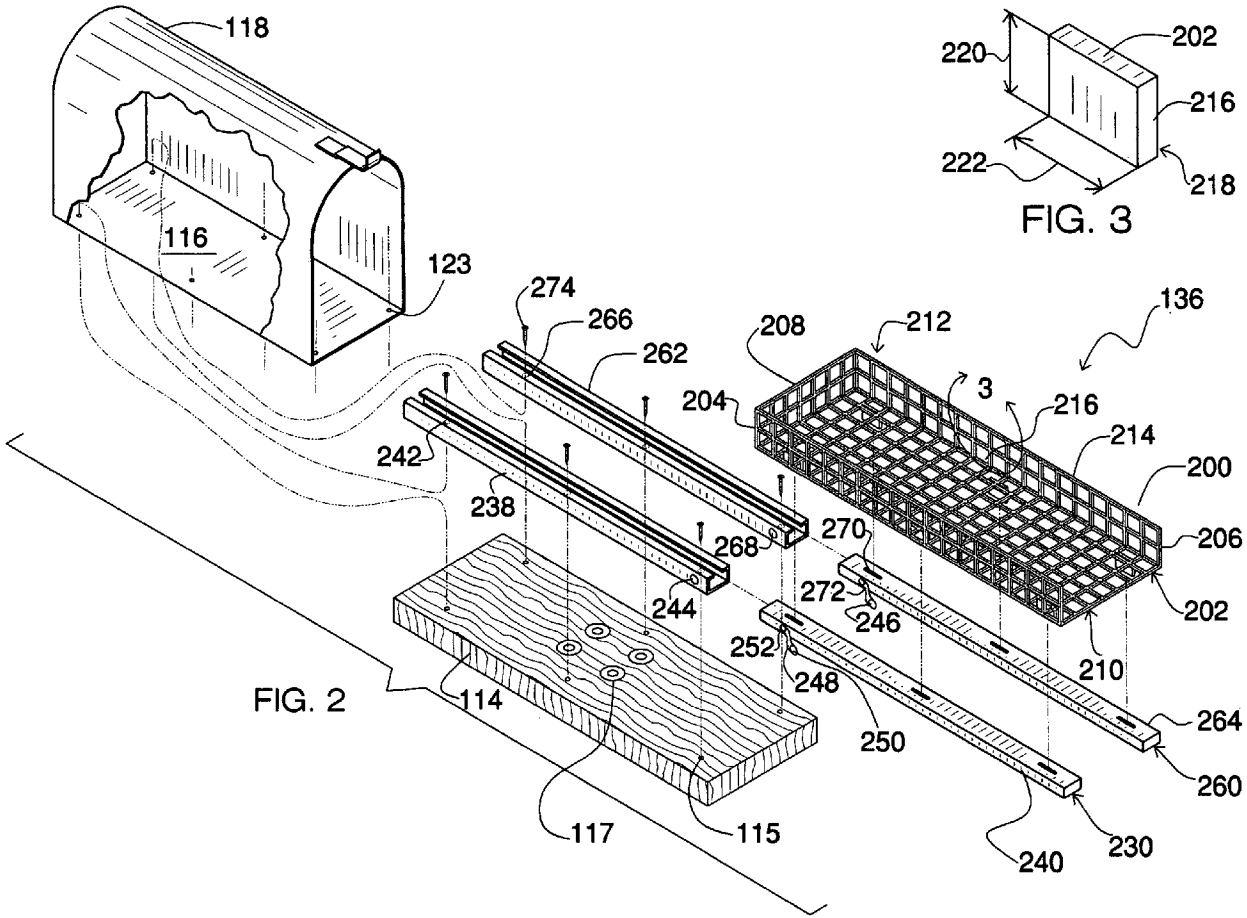
FIG. 2 is an exploded isometric view of parts of mailbox 104, including a basket assembly 136.
FIG. 3 is a detailed section view of tabs 216 taken off line 3 of FIG. 2.

FIG. 2 is an exploded isometric view of parts of mailbox 104, including a basket assembly 136. Basket assembly 136 may be though of as being apart of mailbox 104. Basket assembly 136 may be moveable relative to compartment 120. This, in turn, may permit a user to move materials 121 (FIG. 1) out of or into compartment 120. Basket assembly 136 may include a basket 200, a first slide rail assembly 230, and a second slide rail assembly 260.

Basket 200 may be a gridwork container such as might be formed by intersecting or interwoven elongated strips or strands of metal or plastic. As an openwork container such as a wire basket, basket 200 may permit dirt, leaves, and other debris to fall through to keep materials 121 away from such debris. In addition, its openwork lattice may lighten the weight of basket 200 and provide multiple hand grip locations on which to grab basket 200.

Basket 200 may include a bottom 202 connected to a first side 204, a second side 206, and a rear wall 208 to define an open side 210 and an open top 212. Open side 210 and open top 212 may permit easy delivery and collection of materials 121 from basket 200. At least one of bottom 202, first side 204, second side 206, and rear wall 208 may include a pattern of openings 214. In one embodiment, bottom 202 may include pattern of openings 214 and first side 204, second side 206, and rear wall 208 may be solid. In another embodiment, first side 204 and rear wall 208 may include a pattern of openings 214 and bottom 202 and second side 206 may be solid. A shape of pattern of openings 214 may be square, rectangular, triangular, circular, rhombus, and hexagon or a combination thereof or any recognizably consistent series of contemporary art shapes, such as outlines of Mickey Mouse heads, a dog, or a cat.

The length and width size of the openings in basket 200 may be a function of the minimum dimension established for mail in a particular postal system. For example, the United States Postal Service the minimum dimension for mail is that it must be least 3½ inches high and at least 5 inches long. In one embodiment, the size of the openings in basket 200 may be two inches less than the minimum dimension for mail by a postal system.

Basket 200 additionally may include a plurality of tabs 216. FIG. 3 is a detailed section view of tabs 216 taken off line 3 of FIG. 2. Each tab may have a width 218, a height 220, and a length 222. At least one of width 218 and length 222 may be tapered through a gradual decrease in width or length, respectively, as measured downward from bottom 202. Basket 200 may be a flat, mesh panel made of a durable plastic. Basket 200 may measure eighteen inches long, six inches wide, and one inch high, for example.

First slide rail assembly 230 may include a first stationary rail 238 and a first chassis rail 240 adapted to move relative to stationary rail 236. Here, first chassis rail 240 may be though of as a moving carriage.

First stationary rail 238 may be formed to a desired length from an extrusion having a C-shape. First stationary rail 238 may include a plurality of first rail holes 242. Additionally, first stationary rail 238 may include a first safety hole 244.

First chassis rail 240 may be formed to a desired length from an extrusion having a C-shape, with an outer perimeter that may be small enough to fit within first stationary rail 238. First chassis rail 240 may include a plurality of left slots 246. One or more left slots 246 may have a width or length that may be smaller than tab width 218 or tab length 222, respectively. This may permit first chassis rail 240 to retain basket 200 against a force of less than a slight tug. Alternatively, a width and a length of each left slot 246 may be greater than tab width 218 or tab length 222 such that first chassis rail 240 may not retain basket 200 against any tug force.

Additionally, first chassis rail 240 may include a first safety latch 248. First safety latch 248 may aid in retaining first chassis rail 240 within first stationary rail 238. For example, first safety latch 248 may be a thin piece of flat metal with a first end 250 having a ball-shaped curve and a second end 252 attached to first chassis rail 240. The ball-shaped curve of first end 250 may interact with safety hole 244 of first stationary rail 238 similar to a ball and detent arrangement.

A ball and detent arrangement may be used to hold a moving part in a temporarily fixed position relative to another part where the parts otherwise may slide with respect to each other. The ball may be a single ball bearing, sliding within a rail, against the pressure of a spring, which may push the ball against an interior of the rail, which carries a detent. The detent may be as simple as a hole of a grater or smaller diameter than the ball. When the detent is in line with the ball, the ball may be urged into the detent under spring pressure, holding the parts at that position. Additional force applied to the ball may push the ball back and out of the detent, compressing the spring, and allowing the parts to move once again relative to each other.

In the present arrangement, when first end 250 is positioned in safety hole 244, the arrangement may hold first chassis rail 240 fixed relative to first stationary rail 238. As a flat piece of metal bent to a particular shape, first safety latch 248 may provide a spring force to aid in the ball and detent process. Thus, first safety latch 248 may aid in preventing first stationary rail 238 from separating into two parts and falling to ground 106 (FIG. 1).

Second slide rail assembly 260 may have similar construction and operation as first slide rail assembly 230. Second slide rail assembly 260 may include a second stationary rail 262 and a second chassis rail 264 adapted to move relative to second stationary rail 262. Second stationary rail 262 may include a plurality of second rail holes 266 and a second safety hole 268. Second chassis rail 264 may include a plurality of right slots 270 and a second safety latch 272. In other words, an interior of chassis rails 240 and 264 may include slots 246, 270 into which tab edges 216 of basket 200 may be inserted. Both first slide rail assembly 230 and second slide rail assembly 260 each additionally may include an inner slider and/or a rail assembler to extend a reach of each slid rail assembly and include a spring to make each slide rail assembly spring loaded to automatically move on the release of a button or latch.

Mailbox assembly 100 additionally may include a plurality of fasteners 274 to bring and hold each of the components together. Fasteners 274 may be wood screws, bolts with nuts, toggle bolts with nuts, where the toggle bolt wings may be connected to the external threaded shaft, molly bolts with nuts, and nylon toggle wall grips. Wood screws may permit assembly from inside compartment 120 of mailbox 104. Bolts with nuts, toggle bolts, molly bolts, and nylon toggle wall grips each may permit assembly from below platform 128.

To bring together the components of mailbox assembly 100, post 106 first may be secured to ground 106. Platform 114 may be secured to post 106 by passing bolts (not shown)

through countersunk post holes 117 and securing the bolts to post 106. Since post holes 117 may be countersunk, the tops of the bolts should not extend above an upper surface of platform 114. Next, mailbox 104 may be placed on platform 114 so that base holes 123 of mailbox 104 align with platform holes 115.

First stationary rail 238 may be placed into compartment 120 so that first rail holes 242 may align with base holes 123. Second stationary rail 262 may be placed into compartment 120 so that second rail holes 266 may align with the remaining base holes 123. Fasteners 274 may be placed through platform holes 115, base holes 123, first rail holes 242, and second rail holes 266 and secured.

With the stationary components of mailbox assembly 100 connected to each other, first chassis rail 240 may be inserted into first stationary rail 238 until first safety latch 248 catches safety hole 244. Second chassis rail 264 may be inserted into second stationary rail 262 until second safety latch 272 catches second safety hole 268. With each chassis rail 240 and 264 held in a safety position, basket 200 may be place onto each chassis rails 240 and 264 so that left slots 246 and right slots 270 align with tabs 216 of basket 200. Basket 200 may then be pushed onto each chassis rail 240 and 264 so that tabs 216 pass through left slots 246 and right slots 270.

An exposed portion of first safety latch 248 (e.g., first end 250) and an exposed portion of second safety latch 272 may be pressed to release each chassis rail 240 and 264 from their first stationary rail 238 and second stationary rail 262, respectively. Basket 200 may now be pushed inward past compartment opening 130 and into compartment 120. Door 122 may now be secured to door latch 132. Alternatively, pushing against basket 200 may cause each chassis rail 240 and 264 from their first stationary rail 238 and second stationary rail 262, respectively, without the need to press an exposed portion of first safety latch 248 and second safety latch 272.

With mail material 121 waiting to be retrieved, a user may open door 122, grab onto basket 200, pull basket 200 towards the user, and remove mail material 121. The user additionally may separate basket 200 from first slide rail assembly 236 and second slide rail assembly 260 and bring basket 200 into the user's car to retrieve more easily mail material 121 from basket 200. Basket 200 may be returned to first slide rail assembly 236 and second slide rail assembly 260 by placing tabs 216 into their respective slots 246 and 270. Basket 200 may now be pushed into compartment 120 and door 122 closed.

Figure 4:
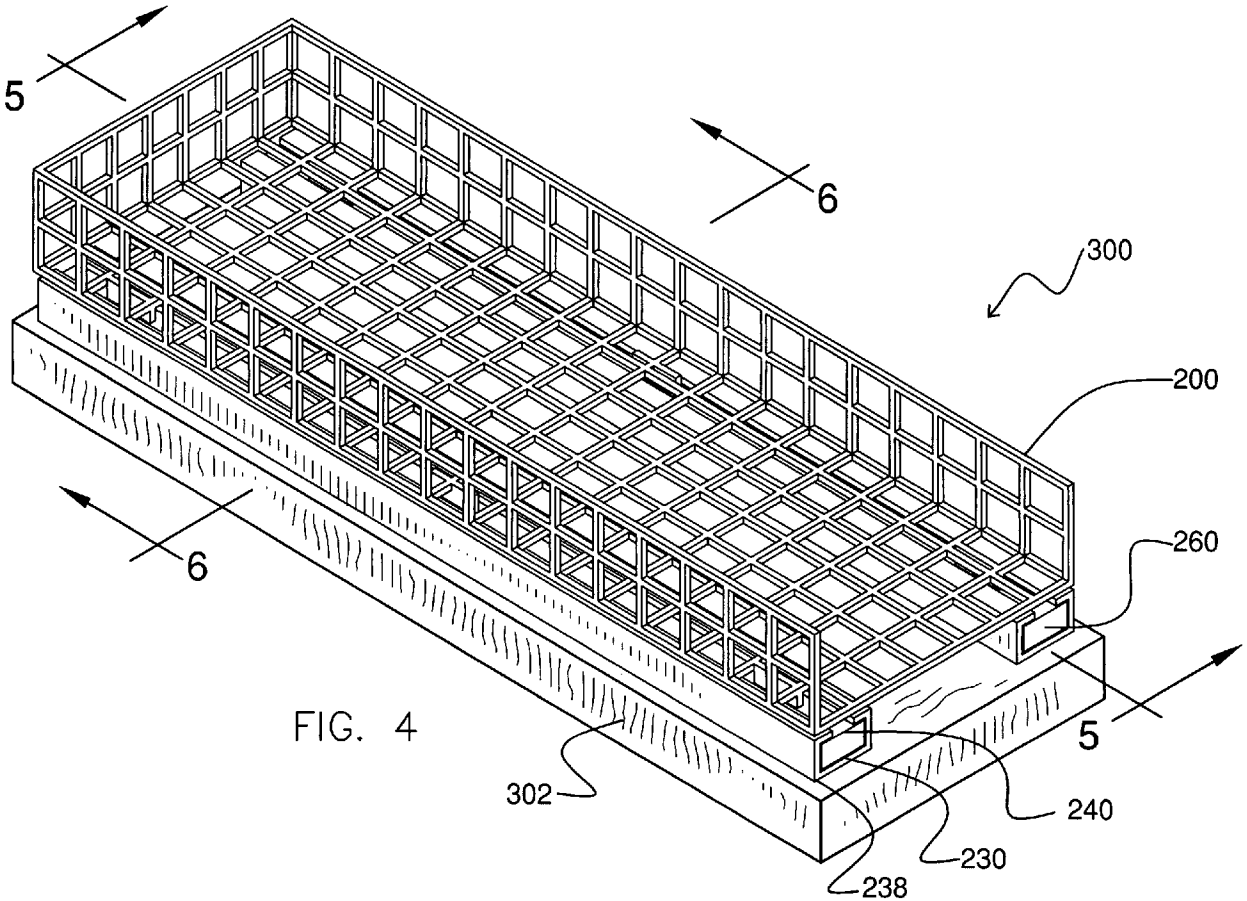
FIG. 4 is an isometric view of a mailbox assembly 400 in a stowed position.
Figure 5:
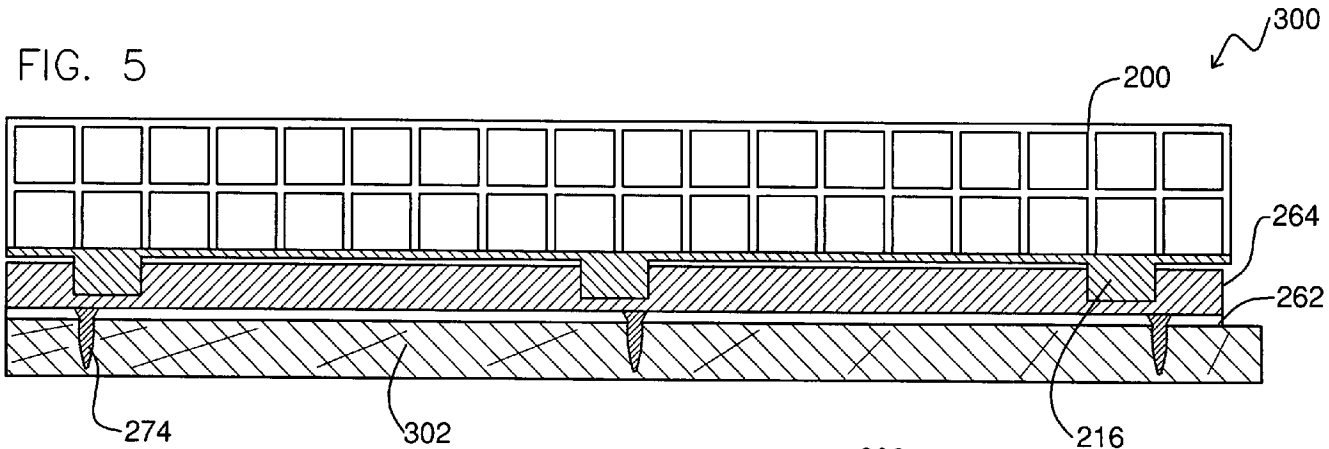
FIG. 5 is an isometric view of mailbox assembly 400 in an extended position.
Figure 6:
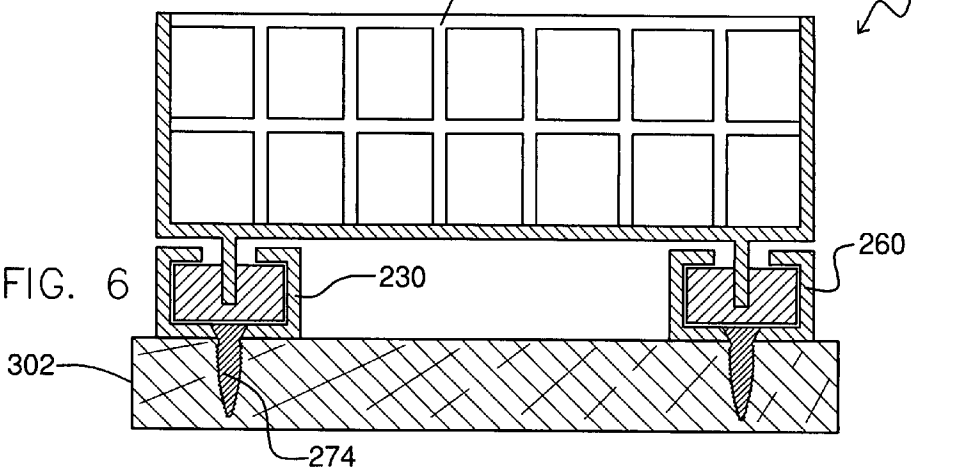
FIG. 6 is a section view of mailbox assembly 400 generally taken off of line 6—6 on FIG. 4.

FIG. 4 is an alternate assembly of a basket assembly 300. FIG. 5 is longitudinal cross section view of basket assembly 300 taken off of line 5—5 of FIG. 4. FIG. 6 is lateral cross section view of basket assembly 300 taken off of line 6—6 of FIG. 4. Basket 200, first slide rail assembly 230, and second slide rail assembly 260 may be attached to a basket platform 302, where basket assembly 300 then may be inserted into mailbox compartment 120 (FIG. 1) to be freely supported by mailbox 104.

Figure 8:
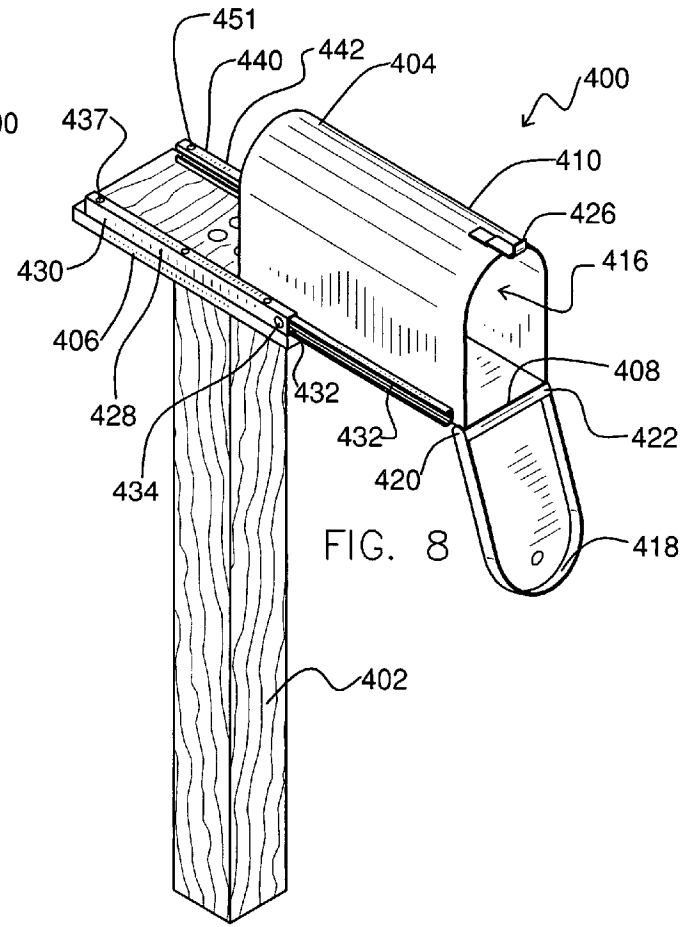
FIG. 8 is an isometric view of mailbox assembly 400 in an extended position.
Figure 7:
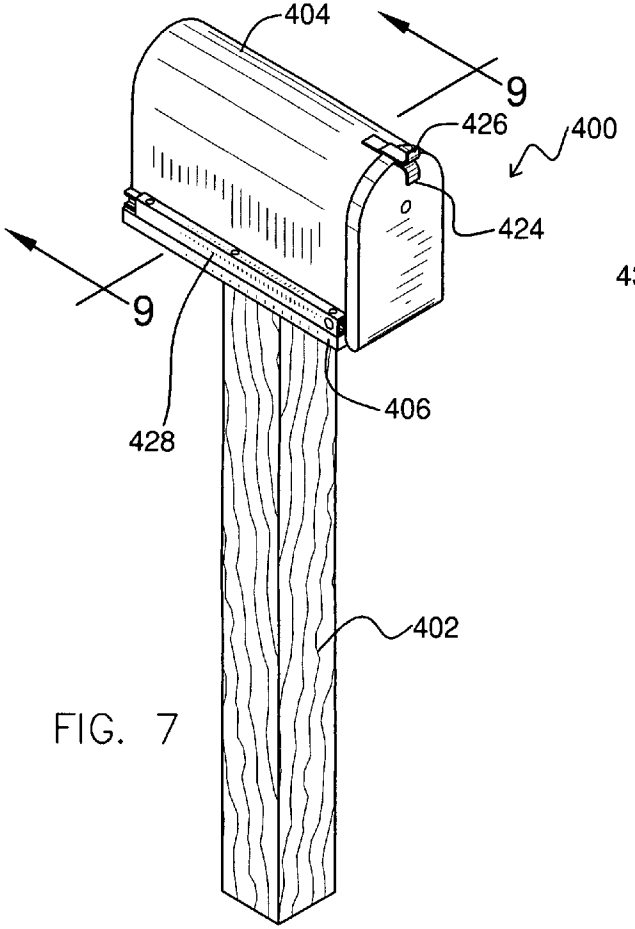
FIG. 7 is an isometric view of a mailbox assembly 400 in a stowed position.
Figure 9:
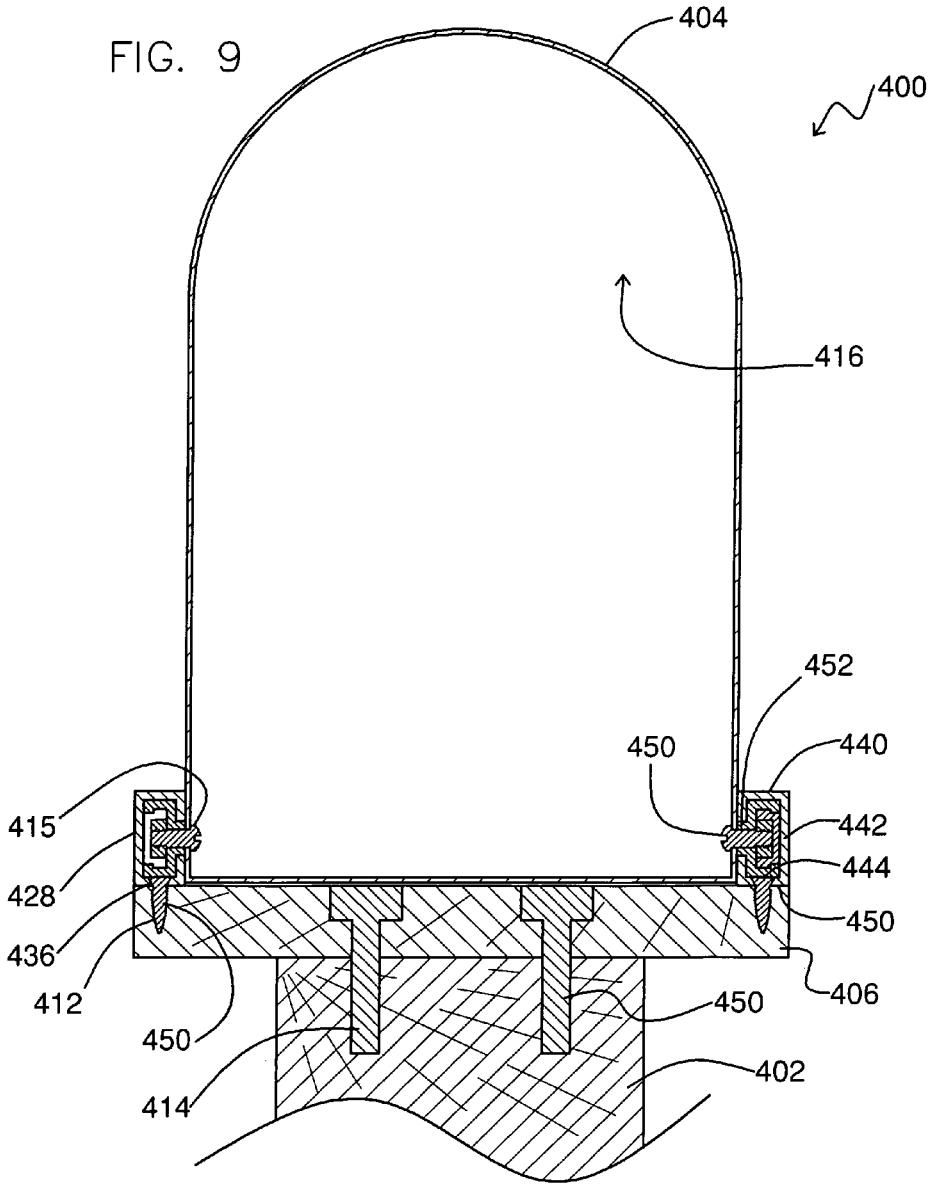
FIG. 9 is a section view of mailbox assembly 400 generally taken off of line 9—9 on FIG. 7.

FIG. 7 is an isometric view of a mailbox assembly 400 in a stowed position. FIG. 8 is an isometric view of mailbox assembly 400 in an extended position. FIG. 9 is a section view of mailbox assembly 400 generally taken off of line 9—9 on FIG. 7. In general, mailbox assembly 400 may include components that may permit most of mailbox assembly 400 to move.

Mailbox assembly 400 may include a post 402 and a mailbox 404. Mailbox 404 may include a platform 406, a base 408, and a cover 410. Platform 406 may include platform holes 412 (see FIG. 9) and countersunk post holes 414 (see FIG. 9). Cover 410 may include cover holes 415 (see FIG. 9). An arrangement of base 408 and cover 410 may form a compartment 416.

Mailbox 400 additionally may include a door 418. Door 418 may be a panel that may swing on a first hinge 420 and a second hinge 422. Door 418 may be connected to cover 410 at a cover end 424 by first hinge 420 and second hinge 422. This may permit door 418 to move with compartment 416 as shown in FIG. 8. Door 418 may include a door handle 424 and be secured to close compartment 416 by a door latch 426.

Mailbox 400 further may include a first slide rail assembly 428 and a second slide rail assembly 440. As shown in FIG. 8, first slide rail assembly 428 may include a first stationary rail 430, a first chassis rail 432 to moveably fit within first stationary rail 430, and a safety latch 432 attached to first chassis rail 432.

First stationary rail 430 additionally may include a first safety hole 434 that may cooperate with safety latch 432 similar to a ball and detent arrangement and may include first stationary holes 436 (FIG. 9) to aid in attaching first stationary rail 430 to platform 406. First stationary rail 430 further may include first access holes 437 aligned with first stationary holes 436 to permit a tool to reach first stationary holes 436. First chassis rail 432 may include first chassis holes 438 (FIG. 9) to aid in attaching first chassis rail 432 to cover 410.

Second slide rail assembly 440 may include a second stationary rail 442, a second chassis rail 444 to moveably fit within second stationary rail 442, and a safety latch 446 (not shown) attached to second chassis rail 442. Further, second stationary rail 442 may include a second safety hole 448 (not shown) that may cooperate with safety latch 446 similar to a ball and detent arrangement and may include second stationary holes 450 to aid in attaching second stationary rail 442 to platform 406. Second stationary rail 430 further may include second access holes 451 to permit a tool to reach second stationary holes 450. Second chassis rail 444 may include second chassis holes 452 to aid in attaching second chassis rail 444 to cover 410.

Mailbox assembly 400 additionally may include a plurality of fasteners 450 to bring and hold each of the components together.

To bring together the components of mailbox assembly 400, post 402 first may be secured to ground 106. Platform 406 may be secured to post 106 by passing fasteners 450 (large wood screws for example) through countersunk post holes 414 and securing fasteners 450 to post 402. Next, first stationary rail 430 may be attached to platform 406 by placing fasteners 450 through first access holes 437 and securing fasteners 450 into both first stationary holes 436 and platform holes 412. Second stationary rail 442 may be attached to platform 406 by placing fasteners 450 through second access holes 451 and securing fasteners 450 into both second stationary holes 452 and platform holes 412.

First chassis rail 432 may be attached to cover 410 by securing fasteners 450 into both cover holes 415 and first chassis holes 438. Second chassis rail 444 may be attached to cover 410 by securing fasteners 450 into both cover holes 415 and second chassis holes 452. Door 418 may be attached to cover 410 using first hinge 420 and second hinge 422. Chassis rails 432, 444 may be inserted into stationary rails 430, 442 respectively, until their respective safety latches 432, 446 catch their respective safety holes 434, 448.

Pressing on safety latches 432, 446 or pushing harder on cover 410 may cause mailbox 404 to move to a position shown in FIG. 7.

In operation, as a user pulls on door handle 424, mailbox 404 may move from the position shown in FIG. 7 to the position shown in FIG. 8. This may move mail material 121 (FIG. 1) closer to the user to make it easier for the user to grab mail material 121.

As noted above in connection with FIG. 2, first stationary rail 238 and second stationary rail 262 may be secured to mailbox 104 with fasteners 274 may be placed through first rail holes 242 and second rail holes 266. Alternatively, a long threaded bolt may be employed to secure first stationary rail 238 and second stationary 262 to mailbox 104.

Figure 10:
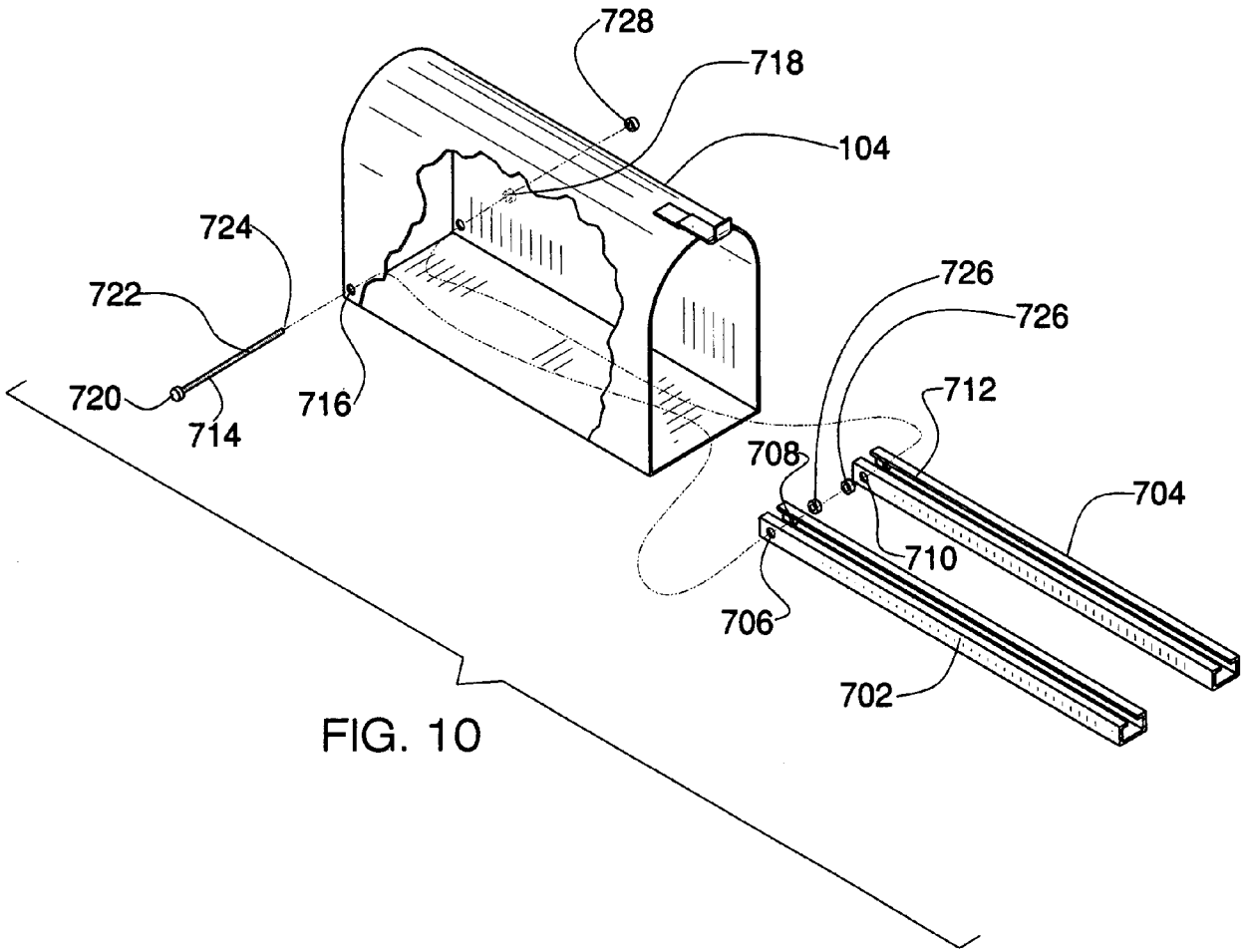
FIG. 10 is an isometric view of a mailbox assembly 700 and an alternate attachment of a first stationary rail 702 and second stationary rail 704 to mailbox 104.

FIG. 10 is an isometric view of a mailbox assembly 700 and an alternate attachment of a first stationary rail 702 and second stationary rail 704 to mailbox 104. First stationary rail 702 may be formed to a desired length from an extrusion having a C-shape. First stationary rail 702 may include a first rear hole 706 and a second rear hole 708. Second stationary rail 704 may include a third rear hole 710 and a fourth rear hole 712. Mailbox assembly 700 additionally may include a bolt 714 and a mailbox 104 may include a first bolt hole 716 and a second bolt hole 718.

Bolt 714 may be a twelve inch bolt having a bolt head 720 and a threads 722 that may extend over six inches to twelve inches as measured from an end 724 of bolt 714. To secure first stationary rail 702 and second stationary rail 704 to bolt 714, mailbox assembly 700 may include locking washers 726—two locking washers 726 in one example. Locking washers 726 may be #2 locking washers with ¼ inch inside diameter. To hold bolt 714 in place, mailbox assembly 700 may include a nut 728, where nut 728 may be a ¼ inch wing nut or hex nut.

To assemble mailbox assembly 700, first stationary rail 702 and second stationary rail 704 may be placed into mailbox 104 so that first rear hole 706, second rear hole 708, third rear hole 710, and fourth rear hole 712 may be aligned with first bolt hole 716 and second bolt hole 718. Bolt 714 may be passed through first bolt hole 716, first rear hole 706, and second rear hole 708. A first locking washer 726 and a second locking washers 726 may be placed on bolt 714. Bolt 714 may then be passed through third rear hole 710, fourth rear hole 712, and second bolt hole 718. A lock washer may be place over bolt 714 and nut 728 may be screwed onto threads 722. Excess length of bolt 714 may be cut off.

Figure 11:
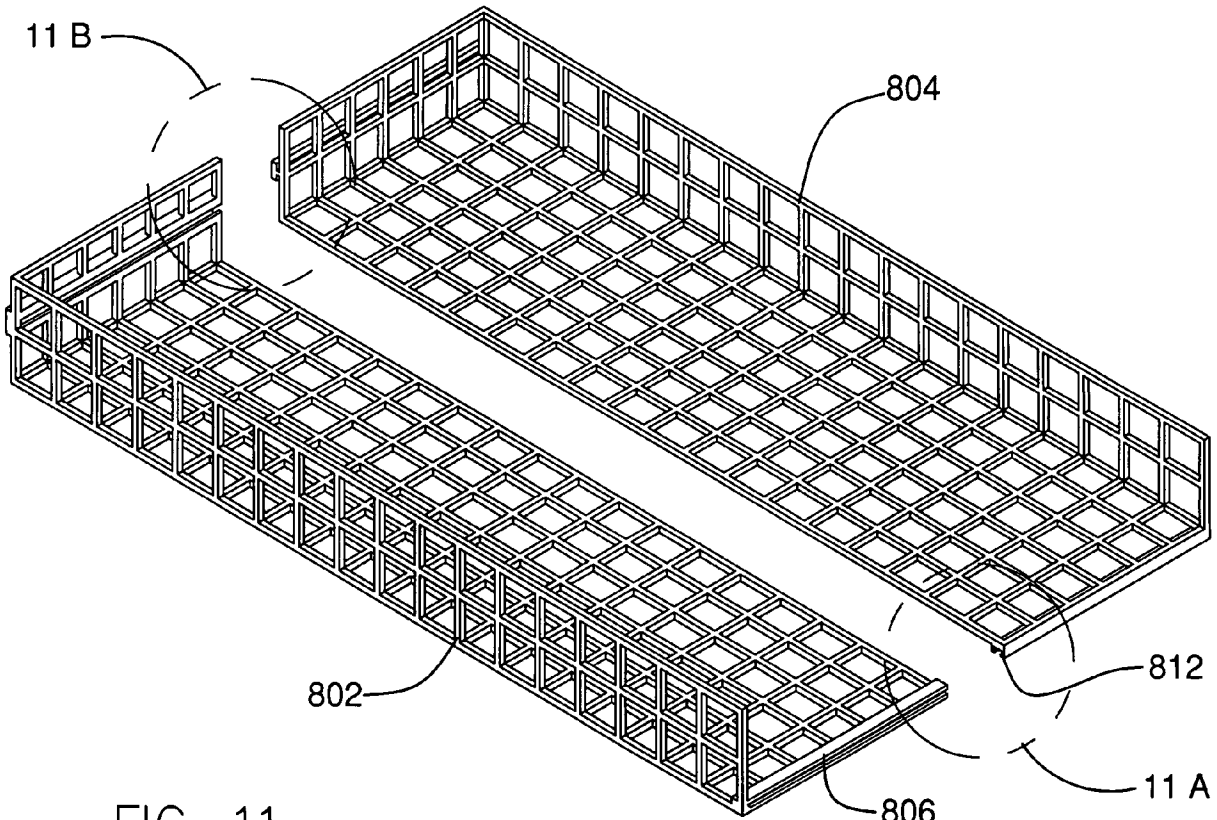
FIG. 11 is an isometric view of a basket 800.
Figure 11A:
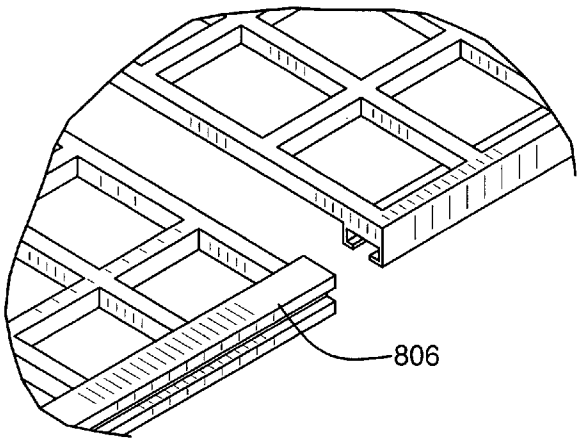
FIG. 11A is a detailed view of FIG. 11 taken off of line 11A of FIG. 11.
Figure 11B:
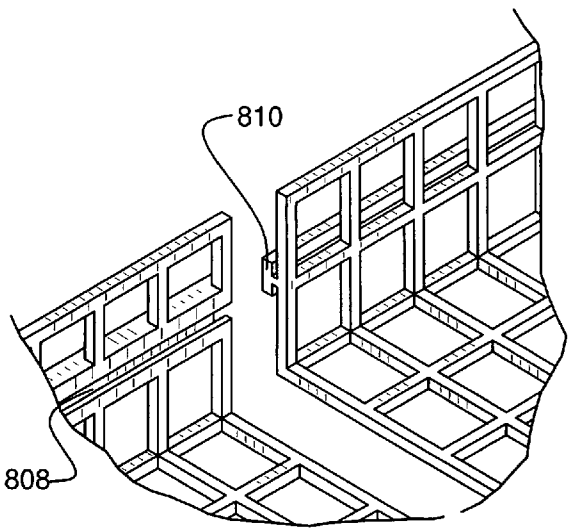
FIG. 11B is a detailed view of FIG. 11 taken off of line 11B of FIG. 11.

As note above, basket 200 may be a gridwork container such as might be formed by intersecting or interwoven elongated strips or strands of metal or plastic. FIG. 11 is an isometric view of a basket 800. FIG. 11A is a detailed view of FIG. 11 taken off of line 11A of FIG. 11. FIG. 11B is a detailed view of FIG. 11 taken off of line 8B of FIG. 11. Basket 800 may include a first piece 802 and a second piece 804. First piece 802 may include a front T-tab 806 and a rear C-channel 808. Second piece 804 may include a rear T-tab 810 and a front C-channel 812. The T-tabs and C-channels may fit together and slide relative to one another. This may allow for expanding and contracting of a width of basket 800 to fit various sized mailboxes.

The mail box assembly may enable mail to be more easily inserted into or retrieved from a roadside mailbox, especially where a person delivers or retrieves mail from a vehicle. The mail box assembly may permit a person to reach a roadside mailbox that was enclosed by a bank of snow. After a simple installation, basket 200 may slide back and forth simultaneously with chassis rails 240 and 264. Basket 200 may be completely pushed into mailbox 104 or pulled from compartment 120 to an easily accessed position. Mail material 121 may be accessed and removed easily from basket 200 after basket 200 had been pulled towards the user. A mail carrier also may conveniently place mail within mailbox 104 during delivery.

Mailbox assembly 100 may be emptied through the same opening as through which mailbox assembly 100 is filled. Alternatively, mailbox assembly 100 may be emptied through compartment opening 130 and filled through an opening other than compartment opening 130. Mailbox assembly 100 may receive material 121 at intervals and be emptied or discharged in bulk. Mailbox assembly 100 may be filled and emptied by the same person or by different persons.

The mailbox assembly works towards fulfilling the need for an extendable basket mounted within an interior of a curbside or rural mailbox to make it easier to deliver mail or retrieve mail. Appealing features of the mailbox assembly includes its ease of installation and use, convenience, durability, accessibility to mail, and affordability. The mailbox assembly may allow a person to deliver or retrieve mail while sitting in a vehicle. That person no longer may need to step from the vehicle. In some cases, homeowners may no longer have to worry about reaching over a snow pile to retrieve their mail during winter. With all the delivered mail brought closer to the user, a user may be more successful at retrieving all the delivered mail and not leave a mail piece behind.

The mailbox assembly may be installed by rural and suburban homeowners and others desiring such a product. The mailbox assembly especially may be beneficial for the elderly or for those people with physical disabilities. Commercial businesses with roadside mailboxes may utilize the mailbox assembly as well.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A curbside mailbox assembly having a mailbox adapted to be attached to a post, the mailbox comprising:

a base and a cover attached to the base to form a compartment;

a platform attached to the base;

a door attached to the platform; and a basket assembly removeably located within the compartment and having a basket, a first slide rail assembly, and a second slide rail assembly, where the basket is an openwork container and includes a plurality of tabs to secure the basket to the first and second slide rail assemblies.

2. The mailbox of claim 1, where the basket includes a bottom connected to a first side, a second side, and a rear wall to define an open side and an open top.

3. The mailbox of claim 2, where at least one of the bottom, the first side, the second side, and the rear wall include a pattern of openings.

4. The mailbox of claim 3, where the bottom includes a pattern of openings.

5. The mailbox of claim 3, where the first side and the rear wall include a pattern of openings.

6. The mailbox of claim 3, where the pattern of openings is a contemporary art shape.

7. The mailbox of claim 3, where a length and a width size of openings in the basket are a function of minimum dimension established for mail in a postal system.

8. The mailbox of claim 1, where each tab defines a width, a height, and a length, where the width is tapered such that width of the tab has a greater dimension than a width of a slot in the first side rail assembly.

9. The mailbox of claim 1, where the basket measures approximately eighteen inches long, six inches wide, and one inch high.

10. The mailbox of claim 1, where the first slide rail assembly includes a first stationary rail having a first rear hole and a second rear hole, where the second slide rail assembly includes a third rear hole and a fourth rear hole, where the mailbox further comprises:

a bolt, a first bolt hole, a second bolt hole, locking washers, and a nut.

11. The mailbox of claim 1, where the basket includes a first piece and a second piece, where the first piece includes a front T-tab and a rear C-channel and the second piece includes a rear T-tab and a front C-channel.

* * * * *